US006895707B2

(12) United States Patent
Young

(10) Patent No.: US 6,895,707 B2
(45) Date of Patent: May 24, 2005

(54) SYSTEM FOR PREVENTING ACCIDENTAL OR UNAUTHORIZED FIRING OF A FIREARM

(75) Inventor: Daniel A. Young, Loveland, CO (US)

(73) Assignee: VisuaLock, Inc., Freemont, CA (US)

( * ) Notice: Subject to any disclaimer, the term of this patent is extended or adjusted under 35 U.S.C. 154(b) by 0 days.

(21) Appl. No.: 10/630,266

(22) Filed: Jul. 30, 2003

(65) Prior Publication Data

US 2004/0025394 A1 Feb. 12, 2004

Related U.S. Application Data

(60) Provisional application No. 60/446,240, filed on Feb. 7, 2003, and provisional application No. 60/400,731, filed on Aug. 2, 2002.

(51) Int. Cl.[7] ..... F41A 17/44
(52) U.S. Cl. ..... 42/70.11; 42/96
(58) Field of Search ..... 42/70.11, 96

(56) References Cited

U.S. PATENT DOCUMENTS

| | | | | | |
|---|---|---|---|---|---|
| 2,327,334 | A | * | 8/1943 | Parker | 42/70.11 |
| 2,478,098 | A | * | 8/1949 | Hansen | 42/70.11 |
| 2,479,107 | A | * | 8/1949 | Garretson | 42/76.01 |
| 2,923,323 | A | * | 2/1960 | Franck | 138/89 |
| 3,360,880 | A | * | 1/1968 | Finnegan | 42/66 |
| 3,388,297 | A | | 6/1968 | Lentz | 42/1 |
| 3,710,490 | A | * | 1/1973 | Cornett et al. | 42/70.11 |
| 3,768,189 | A | * | 10/1973 | Goodrich | 42/96 |
| 4,136,476 | A | * | 1/1979 | Hetrick | 42/70.11 |
| 4,224,753 | A | | 9/1980 | Bielman | 42/1 |
| 4,398,366 | A | * | 8/1983 | Wernicki | 42/70.11 |
| 4,479,320 | A | | 10/1984 | Fix | 42/1 |
| 4,512,099 | A | * | 4/1985 | Mathew | 42/70.11 |
| 4,817,322 | A | * | 4/1989 | Dietz et al. | 42/96 |
| 4,908,971 | A | * | 3/1990 | Chaney | 42/70.11 |
| 4,961,277 | A | | 10/1990 | Rosenbaum | 42/70.11 |
| 4,969,284 | A | * | 11/1990 | Healey et al. | 42/70.11 |
| 5,016,377 | A | * | 5/1991 | Gunning | 42/70.11 |
| 5,062,233 | A | * | 11/1991 | Brown | 42/70.11 |
| 5,171,924 | A | | 12/1992 | Honey et al. | 42/70.11 |
| 5,231,236 | A | * | 7/1993 | Del Real et al. | 42/70.11 |
| 5,233,777 | A | | 8/1993 | Waterman, Jr. et al. | 42/70.11 |
| 5,239,767 | A | | 8/1993 | Briley, Jr. et al. | 42/70.11 |
| 5,241,770 | A | | 9/1993 | Lambert | 42/70.11 |
| 5,261,177 | A | * | 11/1993 | Armstrong | 42/70.08 |
| 5,271,174 | A | | 12/1993 | Bentley | 42/70.11 |
| 5,289,653 | A | * | 3/1994 | Szebeni et al. | 42/70.11 |
| 5,315,778 | A | * | 5/1994 | Wolford | 42/70.11 |
| 5,357,704 | A | * | 10/1994 | Benkovic | 42/70.11 |
| 5,361,526 | A | | 11/1994 | Campbell | 42/70.11 |
| 5,398,438 | A | * | 3/1995 | Williams | 42/70.11 |
| 5,410,832 | A | | 5/1995 | Barnhart | 42/70.11 |
| 5,412,959 | A | * | 5/1995 | Bentley | 70/30 |
| 5,430,966 | A | * | 7/1995 | Hippensteel | 42/90 |
| 5,450,685 | A | | 9/1995 | Peterson | 42/70.11 |
| 5,488,794 | A | * | 2/1996 | Arrequin | 42/70.11 |
| 5,491,918 | A | | 2/1996 | Elmstedt | 42/70.11 |
| 5,860,241 | A | * | 1/1999 | Waters | 42/70.11 |

(Continued)

FOREIGN PATENT DOCUMENTS

| | | | |
|---|---|---|---|
| GB | 2215822 | * | 9/1989 |
| GB | 2234047 | * | 1/1991 |
| WO | WO92/06345 | * | 4/1992 |

*Primary Examiner*—Michael J. Capone
*Assistant Examiner*—John Richardson
(74) *Attorney, Agent, or Firm*—James R. Young; Cochran Freund & Young LLC

(57) ABSTRACT

A firearm locking device increases firearm safety and security. A receiver cartridge shaped and sized with same caliber as firearm is loaded into bullet chamber. A barrel rod is removably engaged to the receiver cartridge and protrudes from the end of firearm barrel. Protruding end serves as fast visual indicator that firearm is unloaded and safe to handle, store, or display. A light pull on protruding end also serves as indicator that firearm is unloaded and safe. A lock and cable serve to lock the barrel rod to firearm's trigger guard to prevent removal of barrel rod from barrel.

23 Claims, 10 Drawing Sheets

U.S. PATENT DOCUMENTS 6,311,422 B1 * 11/2001 Exum et al. ..... 42/70.11
6,314,777 B1 * 11/2001 Allen ..... 42/70.11
6,374,527 B1 * 4/2002 Finardi ..... 42/70.11
6,382,002 B1 * 5/2002 Chen ..... 70/202
6,385,889 B1 5/2002 Zaharek ..... 42/70.11
6,393,750 B1 5/2002 Rossini et al. ..... 42/70.11
6,408,556 B1 6/2002 Achee et al. ..... 42/70.11
6,442,881 B1 * 9/2002 Kellerman ..... 42/70.11
6,526,684 B1 * 3/2003 Hickerson ..... 42/70.11
6,543,171 B2 * 4/2003 Kellerman ..... 42/70.11
6,560,910 B1 * 5/2003 McLaren ..... 42/70.11
6,578,308 B2 * 6/2003 Hickerson ..... 42/70.11
6,604,313 B1 * 8/2003 Kress ..... 42/70.11
2001/0034961 A1 11/2001 Hickerson
2002/0092223 A1 7/2002 Blomquist et al.

* cited by examiner

SYSTEM FOR PREVENTING ACCIDENTAL OR UNAUTHORIZED FIRING OF A FIREARM

The present application claims priority to U.S. Provisional Application Ser. No. 60/400,731, filed Aug. 2, 2002, and to U.S. Provisional Application Ser. No. 60/446,240, filed Feb. 7, 2003. Said Provisional Applications are incorporated herein by reference.

BACKGROUND OF THE INVENTION

1. Field of the Invention

This invention relates generally to firearm locks and, more specifically, relates to a system for preventing accidental or unauthorized firing of a firearm and for providing fast visual and tactile indications as to whether or not the firearm is locked effectively and securely.

2. State of the Prior Art

Firearm safety has always carried a high importance for firearm owners and vendors. Accidental shootings can occur, when children and other persons, who are not familiar with firearms, find and handle unlocked guns at home or elsewhere. Firearm owners and vendors can inadvertently discharge firearms when cleaning them or when demonstrating their use. Also, loaded firearms can discharge unexpectedly when dropped or jostled. Even experienced and trained firearms users, instructors, and vendors can, and sometimes do, accidentally discharge firearms when they mistakenly believe firearms to be unloaded, because a loaded firearm normally looks the same as an unloaded firearm. Therefore, unless they are on a firing range, it is prudent to ensure that firearms are unloaded before they are displayed by vendors and handled by potential customers.

In addition to the risk of accidental shooting, an inadequately locked or unlocked firearm can also be misused intentionally. A securely locked firearm reduces the risk that it will be used unlawfully and allows the owner to exercise more control over when, where, and how the firearm is used. The presence of a firearm lock can deter theft and misuse.

Existing firearm locks fall essentially into three categories, i.e., trigger locks, cable locks, and barrel locks. Trigger locks typically feature a cover or blocking mechanism to either prevent access to the trigger by covering the trigger guard, or to physically restrict movement of the trigger itself and thereby prevent it from being pulled. However, trigger locks do not prevent accidental firing of a firearm due to rough handling, dropping, or other physical tampering with the firearm. Trigger locks do not indicate whether live ammunition is present within the chamber, and they do not prevent the loading of ammunition. Finally, trigger locks may interfere with the display or demonstration of how a particular firearm feels in a person's grip, if a cover blocks the entire trigger guard. Cable locks often require removal of the magazine and opening of the slide on automatic-loading firearms. Barrel locks often require complex tools and complicated or time-consuming installation.

Most existing gun lock mechanisms remain useful only when locked, and they provide no visual indication whether or not the firearm is loaded with live ammunition. Some lock devices also require extensive modifications or variations to adapt to different firearms.

Although most firearm lock devices do restrict use of the firearm in some fashion, not all of them secure the firearm in a way that requires a key or numerical combination to use the firearm. In fact, some of them can be removed with nothing more than common tools. There are some standards for firearm lock effectiveness. For example, the State of California currently has regulations that require a firearm lock for handguns to withstand approximately ten minutes of unauthorized attempts to defeat them with standard household tools, and few convenient, reasonably priced locks meet that standard. Finally, many existing firearm locks have loose-fitting and/or irregular shaped parts that can move freely inside a gun barrel, which can scratch, dent, or otherwise cause damage to the gun barrel bore or rifling grooves.

SUMMARY OF THE INVENTION

Therefore, a general object of this invention is to provide a convenient, reasonably priced lock for firearms that is effective to inhibit unauthorized or accidental discharge.

Another object of this invention to provide an effective and convenient firearm lock that also provides a fast visual indication of whether or not the firearm is loaded.

Another object of this invention is to provide a firearm lock that provides a tactile indication of whether or not the firearm is unloaded and locked securely.

Another object of this invention is to inhibit accidental introduction of live ammunition.

Another object of this invention is to inhibit the intentional introduction of live ammunition by securing a firearm with a lock that requires a key or combination to open.

Another object of this invention is to provide a firearm lock capable of fast and easy installation and that can, at least in some embodiments, meet or exceed the State of California regulations for handgun locks.

Another object of this invention is to provide a firearm lock that does not scratch or otherwise damage the inside of a firearm barrel or the exterior of the firearm.

Another object of this invention is to provide a firearm lock that works with different types and sizes of firearms.

Additional objects, advantages, and novel features of the invention are set forth in part in the description that follows and will become apparent to those skilled in the art upon examination of the following description and figures or may be learned by practicing the invention. Further, the objects and the advantages of the invention may be realized and attained by means of the instrumentalities and in combinations particularly pointed out in the appended claims.

To achieve the foregoing and other objects and in accordance with the purposes of the present invention, as embodied and broadly described herein, the apparatus of the present invention includes a firing chamber plug to be loaded into the firing chamber of a firearm and secured in that position by releaseable connection to a barrel rod that extends through the barrel of the firearm. The firing chamber plug is preferably, but not essentially, of the same caliber and general size as a bullet cartridge normally used by the firearm. One example embodiment firing chamber plug has a threaded bore to receive and threadably connect to a threaded portion of the barrel rod. Another example embodiment of the firing chamber plug has a bore with a shoulder to releaseably engage a barrel rod with radially protruding latch balls. Another embodiment of the firing chamber plug has a grooved opening to releaseably engage a barrel rod with radially protruding latch pins.

To further achieve the foregoing and other objects and in accordance with the purposes of the present invention, as embodied and broadly described herein, the apparatus of the present invention includes a barrel rod, lock, and cable. The barrel rod fits within the barrel of a firearm, removably engages a firing chamber plug, and protrudes out of the muzzle of the firearm. With a brief glance or a slight pull, the protruding barrel rod indicates whether the firearm is unloaded and is safe to handle, store, and display. A cable or other lock device passes through a hole in the protruding distal end of the barrel rod and can have a permanent loop on each end. The barrel rod can then be locked to the trigger guard of a firearm by passing the lock bar of a lock device through the trigger guard and through the permanent loops in the cable before locking the lock device. Other embodiments of the barrel rod, firing chamber plug, cable, and lock can also be used to achieve the objects in accordance with this invention.

BRIEF DESCRIPTION OF THE DRAWINGS

The accompanying drawings, which are incorporated in and form a part of the specifications, illustrate the preferred embodiments of the present invention and, together with the descriptions, serve to explain the principles of the invention. In the Drawings.

DETAILED DESCRIPTION OF THE PREFERRED EMBODIMENTS

Figure 1:
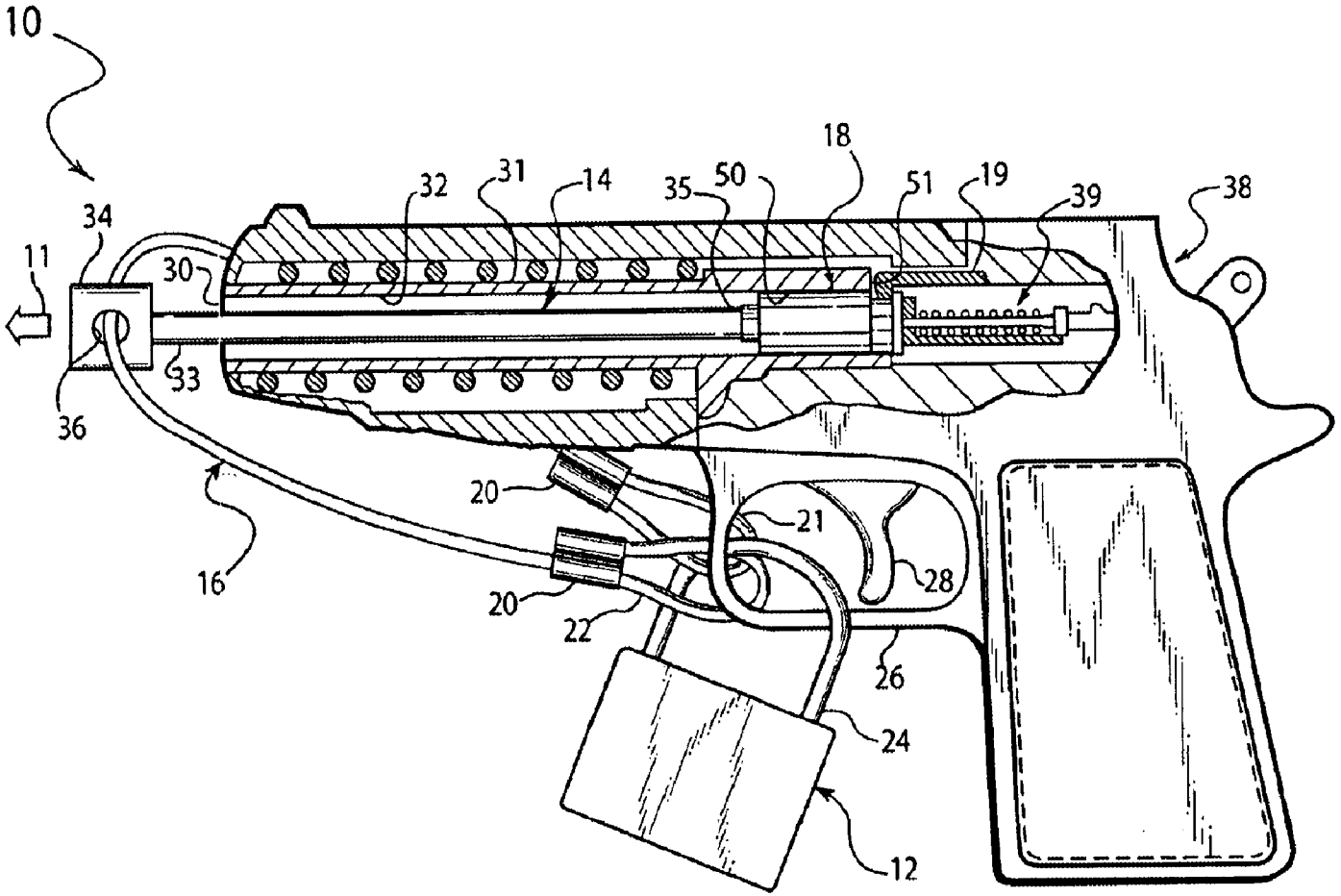
FIG. 1 is a side elevation view of a handgun equipped with a firearm locking apparatus of this invention, wherein a portion of the handgun is cut away to reveal how the locking apparatus fits in firing chamber and barrel of the handgun.

A firearm lock 10, according to this invention, is shown in FIG. 1 mounted in a handgun 38 for preventing use of the firearm 38 and to indicate there is no live round of ammunition in the firing chamber 50. The firearm lock 10 comprises: (i) a firing chamber plug 18 that is shaped and sized to fit in the firing chamber 50 of the firearm 38; (ii) an elongated barrel rod 14 that is inserted through the bore 32 of the barrel 31 from the muzzle 30 into releaseable connection with the firing chamber plug 18; (iii) a cable 16 extending from a knob 34 of the barrel rod 14 to the trigger guard 26; and (iv) a locking device 12, such as a paddle lock, extending through the trigger guard 26 and attached to at least one of, and preferably both of the ends 21, 22 of the cable 16. When the firearm lock 10 is installed and locked in this position, as shown in FIG. 1, the firing chamber plug 18 prevents any loading of a live ammunition round or cartridge (not shown) into the firing chamber 50. The distal end portion 33 of the barrel rod 14 protruding from the muzzle 30 provides a visual indicator that the firearm lock 10 is in place, and the lock device 12 in combination with the cable 16 and trigger guard 26 prevent the firearm lock apparatus 10 from being removed from the firearm 38. For further assurance that the plug 18 is in place in the firing chamber 50, a user can exert a small tug on the knob 34 in the direction of the arrow 11. If the proximal end 35 of the rod 14 is properly connected to the plug 18, the rim 17 on the plug 18 interacts with an ejection finger 19 to prevent the rod 14 from moving in the direction of the arrow 11, thereby providing a tactile indication that the firearm lock apparatus is properly installed with the plug 18 in its proper place in the firing chamber 50. The plug 18 is shaped similarly to, and has the same caliber as, a cartridge of correct caliber for use with the firearm 38, so it can be inserted into the firing chamber 50 through the breech 39 of the firearm 38. Therefore, while the rim 19 can be sized and configured for engagement by the ejection finger in firearm 38 models that work in that manner, other firearm models require cartridges with larger rims 17 that can bear against a shoulder 51 around the proximal end of the firing chamber 50 to limit forward movement of the plug 18 into the firing chamber 50. Either way, when the plug 18 is positioned in the firing chamber, it is not possible to place a real, live round of ammunition in the firing chamber 50, when the plug 18 is positioned properly in the firing chamber 50.

In this description the terms "proximal" and "distal" are used in relation to a person holding the firearm 38 in a normal manner with a hand wrapped around the grip and a finger on the trigger. Therefore, "proximal" is toward such a person, i.e., to the rear of the firearm 38, and "distal" is away from such a person, i.e., to the front of the firearm 38.

Figure 2:
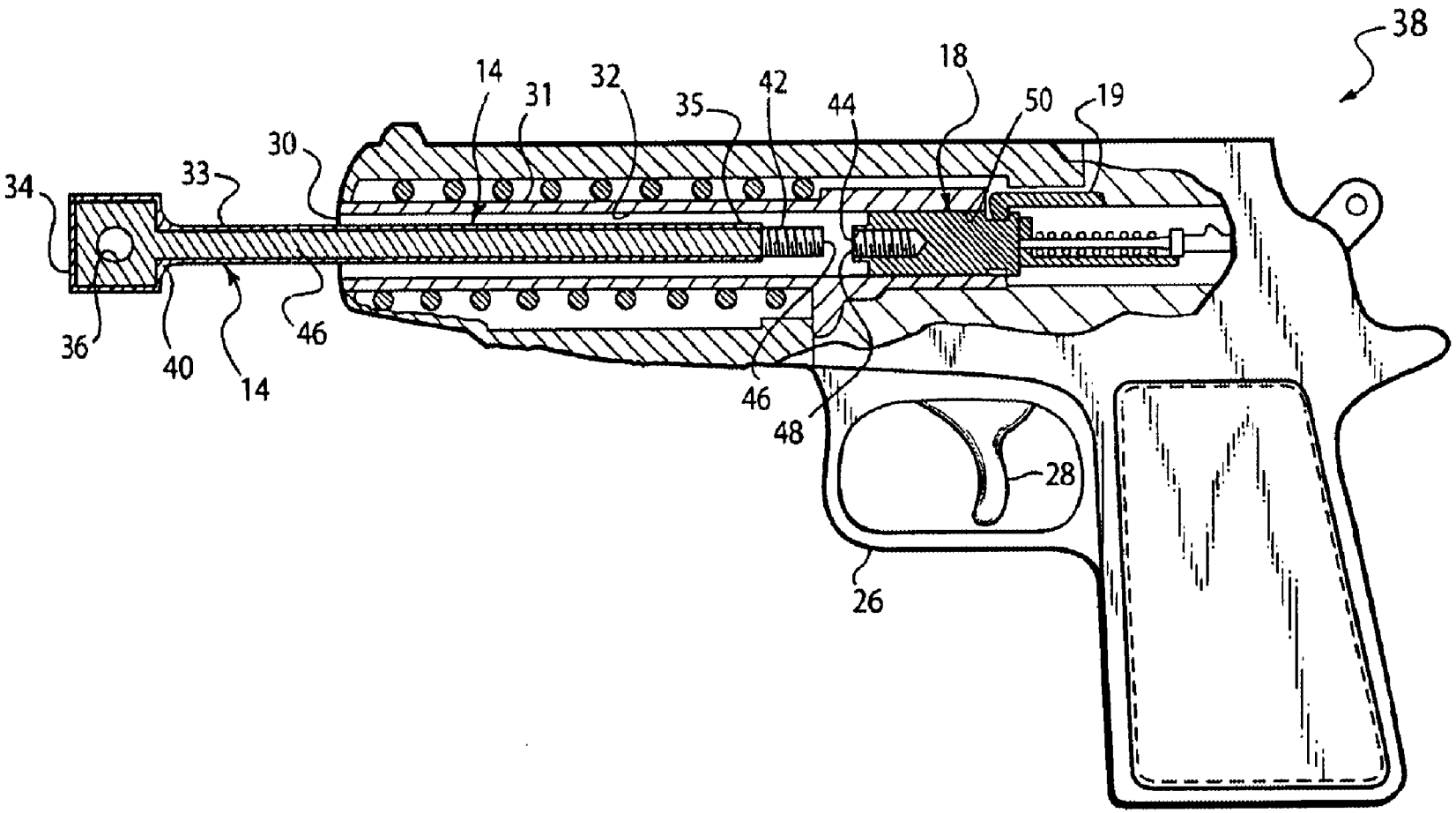
FIG. 2 is a cross-sectional view of the barrel rod and firing chamber plug of the firearm locking apparatus in FIG. 1 positioned in a side elevation, cut away view of the handgun.
Figure 3:
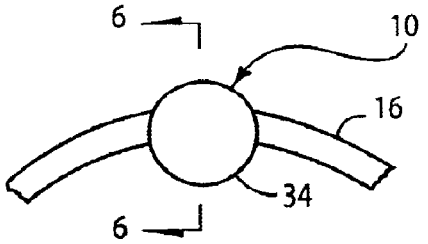
FIG. 3 is a front or distal end elevation view of the firearm locking apparatus of this invention, but showing only a portion of the cable, which extends through the knob of the locking apparatus.
Figure 4:
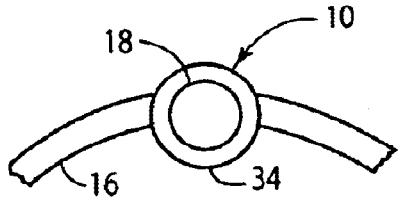
FIG. 4 is a rear or proximal end view of the firearm locking apparatus.
Figure 5:
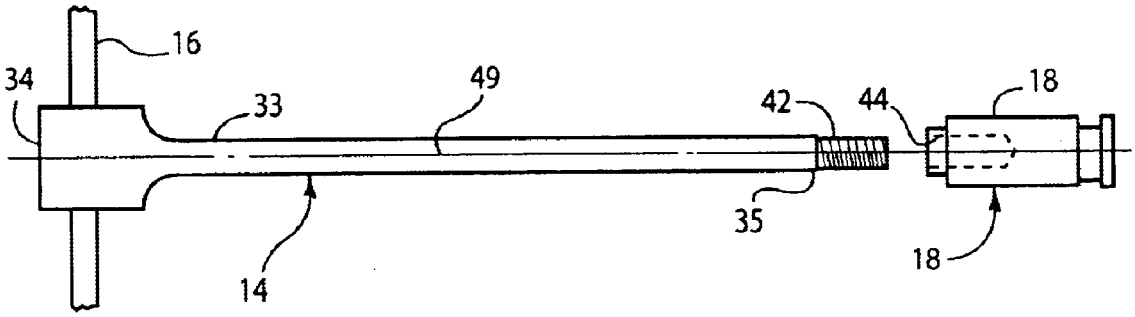
FIG. 5 is a top plan view of the firearm locking apparatus shown with the threaded portion 42 of the rod 14 unscrewed from the plug.
Figure 6:
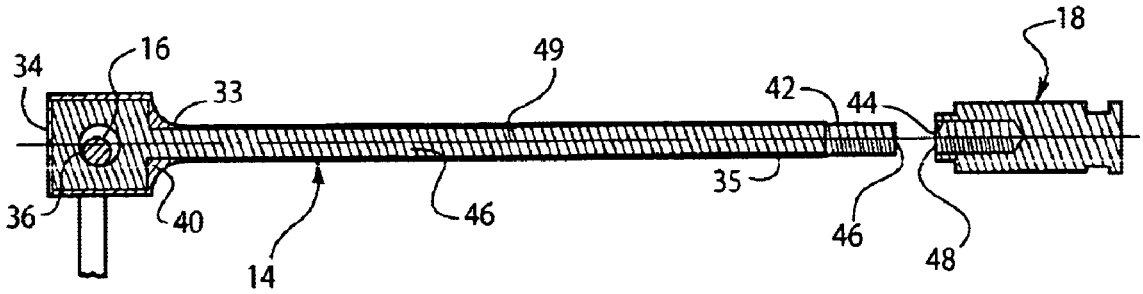
FIG. 6 is a cross-sectional view of the firearm locking apparatus taken along section line 6–6 of FIG. 3.

The barrel rod 14 has a diameter that is small enough for insertion into the muzzle 30 of the barrel 31 and is long enough to extend the length of the barrel 31 and for its proximal end portion 35 to be releaseably attached to the plug 18 in the firing chamber 50. For example, as shown in FIG. 2, external threads 42 on the proximal end portion 35 of the rod 14 can be screwed into an internally threaded bore 44 in the plug 18 by turning the rod 14. The rod 14 can, therefore, be detached from the plug 18 by turning the rod 14 in the opposite direction to unscrew its proximal end 35 from the plug 18. Myriad other mechanisms can also be used to releaseably attach the rod 14 to the plug 18 within the scope of this invention, several additional examples of which are described below. When the rod 14 is positioned in the barrel 31 of the firearm 10 and attached to the plug 18 in the firing chamber 50, the plug 18 cannot be removed from the firing chamber 50, as explained above.

The rod 14 is preferably long enough so that the knob 34 at the distal end 33 of the rod 14 is entirely outside of the barrel 31 of the firearm 38, so that it is easy to grasp and to see. The knob 34 has a transverse hole 36 through which the cable 16 passes. With the cable 16 extending through the hole 36 in the knob 34 and its ends fastened to the trigger guard 26, as shown in FIG. 1, the rod 14 cannot be turned enough times to unscrew the threaded end portion 42 (FIGS. 2–6) from the plug 18. The locking device 12 secures the cable end loops 21, 22 to the trigger guard 26.

The cable 16 can be added to the barrel rod 14 during manufacturing of the firearm lock apparatus 10. After cable 16 has been passed through hole 36 during manufacturing, permanent loops 22 can be created at each end of the cable 16 by bending the end of the cable 16 back to the cable 16 itself and securing it there with cable crimp fasteners 20 or by any other method known to persons skilled in the art.

When a firearm 38 owner wishes to lock the firearm 38, the locking device 12 is unlocked and a lock bar 24 or similar lock component is placed through both permanent loops 22 and through the closed trigger guard 26 of the firearm 38. The locking device 12 is then closed and locked to prevent removal of the cable ends 21, 22 from the trigger guard 26. The cable 16 is preferably short enough so that it does not permit the elongated barrel rod 14 to be removed from the barrel 32 of the firearm 38. Also, the cable 16 is stiff enough and short enough so that, as mentioned above, it does not permit the barrel rod 14 to be twisted or turned about its longitudinal axis 49 in a manner that would cause the barrel rod 14 to become unfastened from the plug 18.

Cable 16 is preferably made from hardened steel wire rope, such as aircraft cable, so that it is difficult, if not impossible, to cut with ordinary scissors, pliers, knife, hacksaw, or other household cutting tools. It is also preferably coated with a plastic or rubber polymer coating to prevent scratching or other damage to the firearm 38 that might occur when the cable 16 makes contact or rubs against the exterior of the firearm 38, the trigger 28, or trigger guard 26.

Although FIG. 1 shows the lock bar 24 encircling the trigger guard 26, other variations of locking the barrel rod 14 to the trigger guard 26 can also be used. For example, one of the permanent looped ends 21, 22 can be placed through the trigger guard 26, then the lock bar 24 can be placed through both permanent looped ends 22, and then the locking device 12 can be locked. In this arrangement, the lock bar 24 would not pass through the trigger guard 26, but the cable 16 would still pass through the hole 36 and the trigger guard 26. For this variation, the permanent looped ends 21, 22 are small enough to fit through the trigger guard 26.

In another example variation, the cable 16 can remain independent of the barrel rod 14 and not be passed through hole 36 during manufacture. Instead, one of the permanent looped ends 21, 22 of the cable 16 can be passed through the trigger guard 26. Then the lock bar 24 can be placed through both permanent looped ends 21, 22. The lock bar 24 can then be placed through the hole 36 in the knob 34 and locked. For this alternate embodiment, the permanent looped ends 21, 22 are small enough to fit through the trigger guard 26.

The locking device 12 may be any type of lock, including but not limited to, a keyed lock, a combination lock, an electromagnetic lock, an electronic lock, or a cable lock. In addition, instead of permanent loops in looped ends 21, 22, other embodiments of the present invention may utilize other shapes or configurations that allow the two ends of the cable 16 to be joined and locked together.

During manufacturing, the example firing chamber plug 18 of FIGS. 1–6 is bored and threaded to create an inside threaded portion 44 to receive the externally threaded portion 42 at the proximal end portion 35 of rod 14 to allow the rod 14 to be threadably fastened to the plug 18. The barrel rod 14 and the plug 18 can be made with either a machining or a molding process, and they can be composed of any hard, durable material, such as solid metal, carbon composite, ceramic, nylon, polymer, or other material or combinations of such materials that is resistant to sawing, breaking, melting, and other destructive instrumentalities. In the embodiment of FIGS. 1–6, the example barrel rod 14 is illustrated as comprising a solid metal inside shaft 46 with a polymer or plastic outside layer 40. This polymer or plastic outside layer reduces damage that might occur when the barrel rod 14 makes contact with the metal inside surface 32 of the barrel 31 during installation of the firearm lock 10 or during handling of the firearm 38. The barrel rod 14 and this polymer or plastic outside layer 40 may be colored, for example, in bright red or orange, which is a universal indication of firearm safety.

The barrel rod 14 is generally cylindrical and has a diameter smaller than the caliber of the firearm 38 in which it is installed. This sizing allows the barrel rod 14 to fit within the inside bore 32 of the barrel 31 and to be removably engaged with the plug 18. The knob 34 at the distal end 33 of the barrel rod 14 preferably has a diameter greater than the caliber of the firearm 38 in which it is installed and serves as a handle that can be grasped with a person's fingers to facilitate turning of, or pulling on, the rod 14. A knurled or polyhedron shape (not shown) around the periphery of the knob 34 can facilitate that function, if desired. Therefore, the length of the rod 14 of the barrel rod 14 (apart from the length of the threaded portion 42) is sufficient to allow the knob 34 to protrude out of the muzzle 30 far enough to be screwed, pushed, or turned with fingers.

The first step in using this embodiment of the firearm lock 10 of the present invention is to remove the magazine (not shown), if present, from the firearm 38 as well as any cartridge (not shown) in the firing chamber 50. Next, the plug 18 is loaded into the firing chamber 50, just as a cartridge would be loaded into the firing chamber 50, and closing the slide (not shown) of the firearm 38, if present, or otherwise closing the breach however that function is performed in a particular firearm. The barrel rod 14 is then inserted into the barrel 31 through the muzzle 30. The rod 14 is threadably fastened into the plug 18 by inserting the proximal end 46 of the rod 14 into the threaded bore 48 of the plug 18 and turning the rod 14 about its longitudinal axis 49 to screw the threaded portion 42 of the rod 14 into the plug 18. When the rod 14 is attached to the plug 18 in this manner, the distal end portion 33 and the knob 34 preferably protrude longitudinally outward or forward from the muzzle 30. The magazine (not shown) can then be put back into the firearm 38, if desired.

The knob 34, as well as the exposed end portion 33, serves as a quick visual indicator that this procedure has been followed and that the firearm 38 is currently unloaded and safe to handle, store, or display. A light longitudinal tug or pull on the knob 34 away from the firearm 38, as indicated by arrow 11 in FIG. 1, verifies that the rod 14 does not move, must be securely fastened to the plug 18, which serves as an additional, tactile indicator that this procedure has been followed and that the firearm 38 is currently unloaded and safe to handle, store, or display. If the rod 14 does move when tugged or pulled, the indication is that either the rod 14 is not securely fastened to the plug 18 or that the plug 18 is not even in the firing chamber 50. Therefore, the user should check and perform the lock installation procedure again, if necessary, to be sure the plug 18 is in place in the firing chamber 50 and that the barrel rod 14 is securely attached to the plug 18. The firearm lock 10 serves these indicator functions regardless of whether or not it has the hole 36 or cable 16. However, for additional security, the rod 14 can be locked to the trigger guard 26 using the cable 16 and locking device 12, as shown in FIG. 1 described above. Locking the rod 14 to the trigger guard 26 prevents the removal of the rod 14 from the barrel 31.

Figure 7:
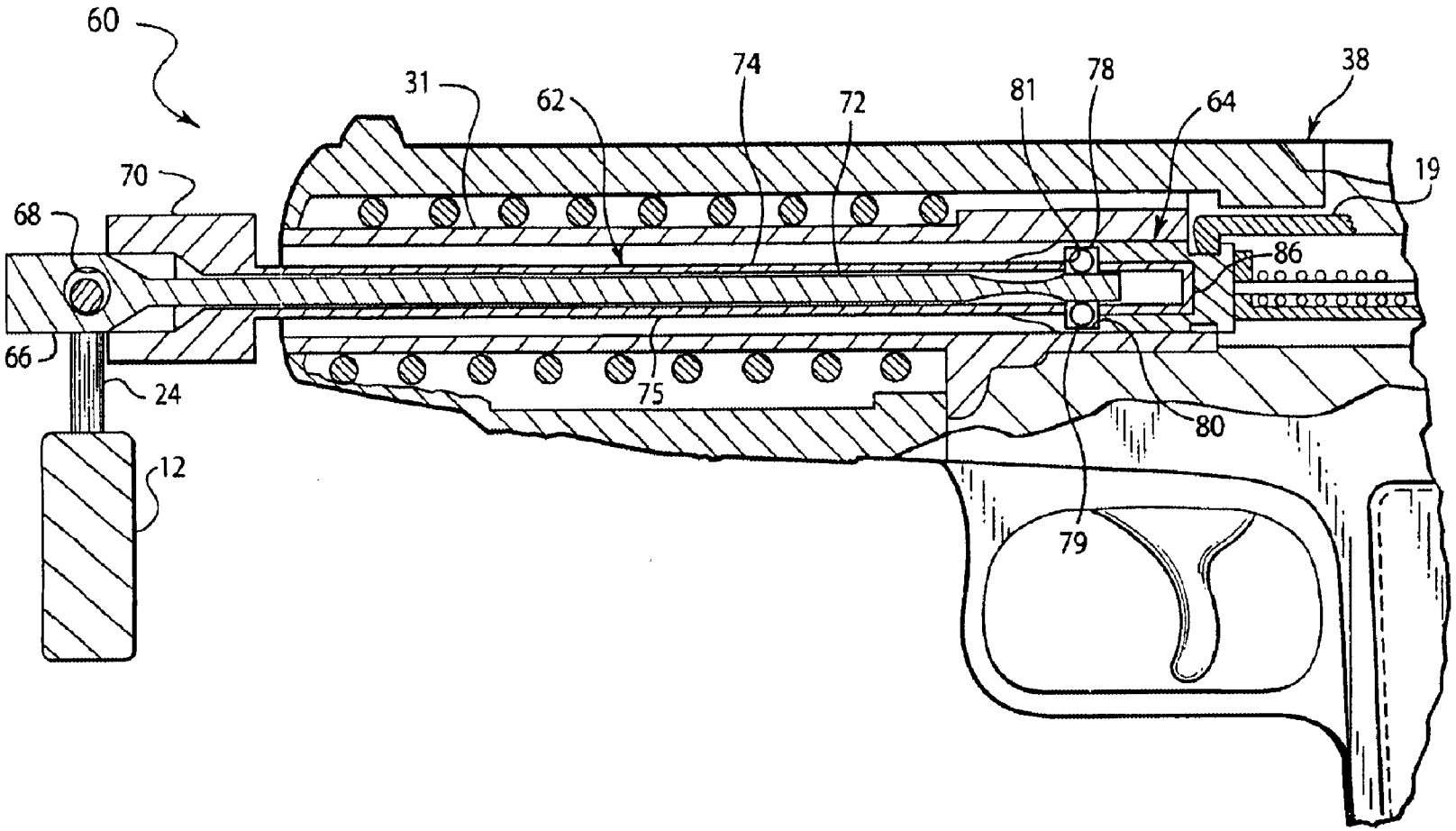
FIG. 7 is a partially cross-sectioned view of a firearm equipped with an alternate embodiment firearm locking apparatus that utilizes radially extendable latch balls.

An alternate embodiment 60 of a barrel rod 62 and plug 64 of the present invention, which is shown in FIGS. 7–12, provides substantially the same overall firearm locking function as described above. However, in this embodiment 60, as shown in FIG. 7, the rod 62 is releaseably connected to the plug 64 by at least one, and preferably more, ball latches 78, 79 protruding from the proximal end portion 63 of the rod 62 into latching engagement with a radially inward extending shoulder 81 in the plug 64. As will be explained in more detail below, the latch balls 78, 79 can be collapsed radially inward to disengage them from the shoulder 81 and thereby release the rod 62 from the plug 64 for removal from the firearm 38.

Figure 8:
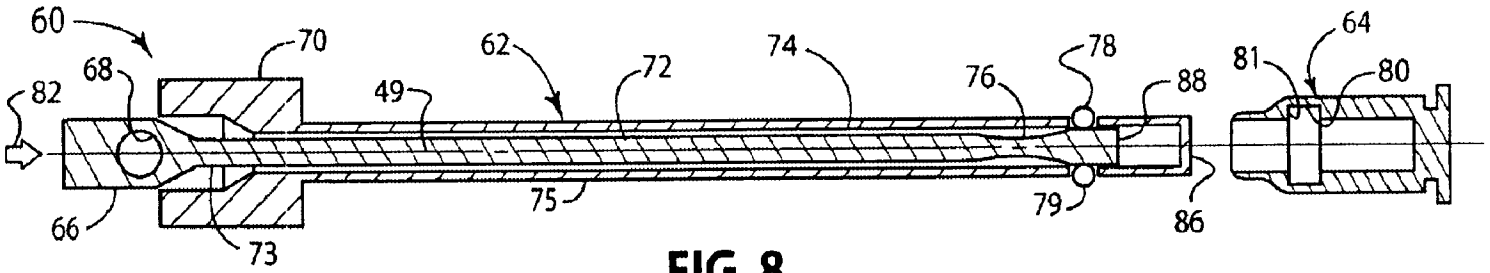
FIG. 8 is a cross-section view of the alternate embodiment of FIG. 7, but in unlocked position with the latch balls extended.
Figure 9:
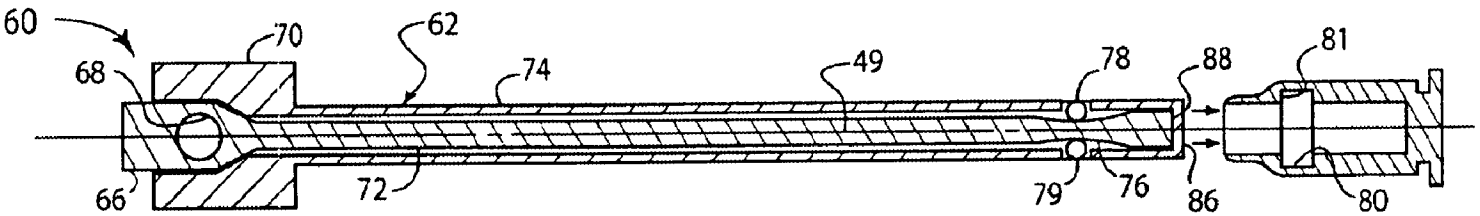
FIG. 9 is a cross-section view similar to FIG. 8 but with the latch balls retracted and ready for insertion into the firing chamber plug.
Figure 10:
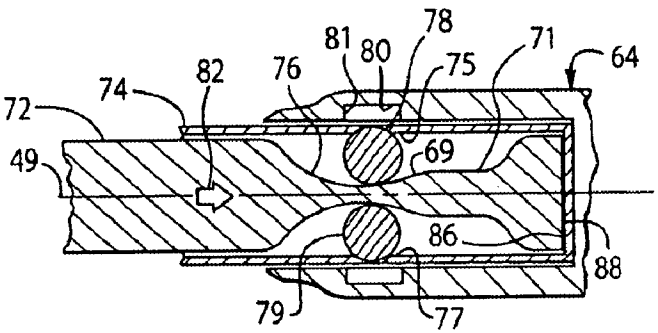
FIG. 10 is an even more enlarged cross-sectional view of the collapsed latch balls similar to FIG. 9, but with the proximal end of the rod inserted into the firing chamber plug.

As best seen in FIGS. 8–10, barrel rod 62 comprises an outer tube or sheath 74 and an inner shaft 72. At the distal end 73 of the inner shaft 72 is a push button 66 with a transverse hole 68 positioned for a locking function as will be described in more detail below. The inner shaft 72 is contained coaxially within the outer tube or sheath 74, and it slides freely in relation to the outer tube or sheath 74. The inner shaft 72 has a fairly uniform diameter throughout the midportion 75 length of the outer tube 74, except as it tapers down to form a narrow cam portion 76 just before the proximal end 88, then tapers back up to an intermediate diameter at a ball seat portion 71 and then to its full diameter again adjacent the proximal end 88.

There are myriad known structures and mechanisms for extending latch balls radially into latching engagements for various uses, many of which could be used in this invention. In this example, latch ball mechanism shown in FIGS. 7–12, the outer tube 74 extends the length of the barrel 31 and comprises a knob portion 70 at its distal end and an end cap 86 at its proximal end. The outer tube 74 in this example rod 62 has two holes 75, 77 on diametrically opposite sides of the outer tube 74 located approximately the same distance from the end cap 86 as extends between the narrow cam portion 76 and the proximal end 88 of the inner shaft 72, although more or fewer holes to accommodate more or fewer latch balls can also be used. The latch balls 78, 79 can protrude through respective holes 75, 77 partially to the outside of the outer tube 74 and they are free to move radially closer to the longitudinal axis 49 of the inner shaft 72, when the cam surface 76 is positioned longitudinally to allow such movement, as will be described below. The latch balls 78, 79 are shown in FIGS. 7–12 as solid metal spheres, but they can have other structures, shapes, or materials. The outer tube 74, inner shaft 72, and latch balls 78, 79 can be manufactured, for example, of solid metal, nylon, or plastic with either a machining, molding, or other suitable process. The outer tube 74 is long enough to allow the narrow cam portion 76 of the inner shaft 72 to be aligned between the two latch balls 78, 79 when the proximal end 88 of the inner shaft 72 makes contact with the end cap 86.

The plug 64 has a bore and with inner diameter only slightly larger than the outer diameter of the outer tube 74, so that the outer tube 74 can be inserted into the bore in the plug 64. The plug 64 also has an annular channel 80 of larger diameter than bore 84 to form the latch shoulder 81. The channel 80 is sized to accommodate and engage both latch balls 78, 79 protruding from the outer tube 74. The outer diameter of the outer tube 74 is smaller than the caliber of bullet cartridges normally used with the firearm 38.

In using the barrel rod 62 and plug 64 of this embodiment, the plug 64 is first positioned in the firing chamber 50 of the firearm 38, as shown in FIG. 7. Then the push button 66 is pushed longitudinally in the direction indicated by arrow 82 while simultaneously grasping the knob 70 in a manner similar to operating a syringe, which causes the inner shaft 72 to slide in the direction of arrow 82 relative to the outer tube 74. When the proximal end 88 of the inner shaft 72 makes contact with the end cap 86 of the outer tube 74, as shown in FIGS. 9 and 10, the narrow cam portion 76 of the inner shaft 72 is aligned between the two latch balls 78, 79. This alignment allows the latch balls 78, 79 to retract or sink radially inwardly through holes 75, 77 toward the longitudinal axis 49 of the inner shaft 72 enough so that the latch balls 78, 79 no longer protrude substantially radially outwardly from the outer tube 74. Next, with the latch balls 78, 79 retracted so as to not protrude outwardly from the outer tube or sheath 44, as shown in FIG. 9, the proximal end 86 of rod 62 is inserted into the muzzle 30, through the barrel 31, and into the bore 84 of the plug 64 in the direction indicated by arrow 82, until the latch balls 78, 79 align with the channel 80 in the plug 64, as shown in FIGS. 10 and 12. The bore 84 in the plug 64 is preferably deep enough such that the latch balls 78, 79 pass into alignment with the channel 80 by the time the end cap 86 reaches the inner, blind end 89 of the bore inside the firing chamber plug 64. The push button 66 can then be pulled outwardly in relation to the outer tube 74, as indicated by arrow 91 in FIGS. 11 and 12, to cam the latch balls 78, 79 radially outwardly through holes 75, 77 and into the annular channel 80 to engage the plug 64 and effectively latch the rod 62 to the plug 64.

Figure 11:
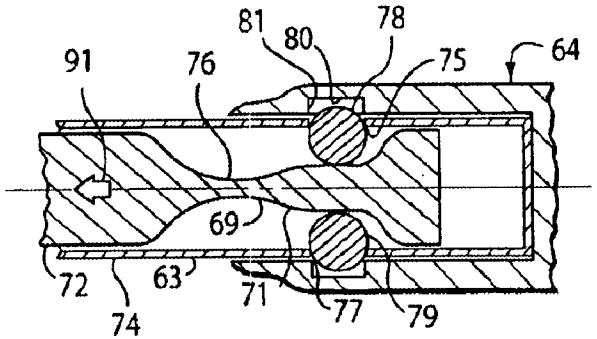
FIG. 11 is another enlarged view similar to FIG. 10, but with components shifted in relation to each other to extend the latch balls into latched position in the firing chamber plug.
Figure 12:
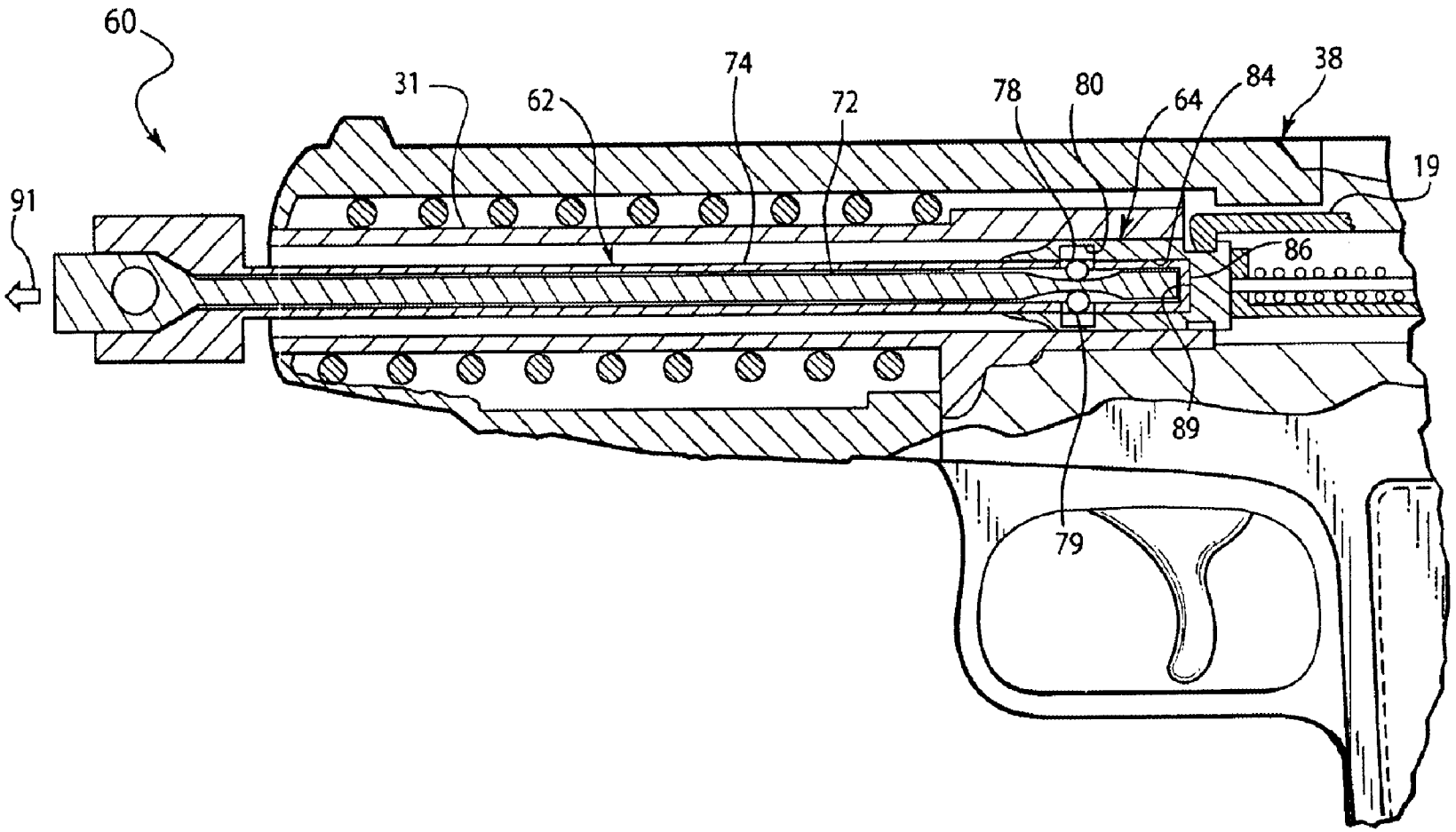
FIG. 12 is an enlarged, partially cross-sectioned view of a firearm similar to FIG. 7, but with the latch balls collapsed for easy insertion of the rod into, or pulling the rod out of, the firing chamber plug and the barrel of the firearm.

As best seen in FIG. 11, the relative sizes of the holes 75, 77, with respect to the latch balls 78, 79, are large enough in diameter to allow portions of the latch balls 78, 79 to protrude radially outwardly through the respective holes 75, 77 into the channel 80, but they are smaller than the diameter of the latch balls 78, 79 so that the latch balls 78, 79 cannot escape through the holes 75, 77 when the rod 62 is not connected to the plug 64. The cam recess 76 in inner shaft 72 is deep enough to contain the latch balls 78, 79 without protrusion of the latch balls 78, 79 radially outward beyond the outer tube or sheath 74, as best seen in FIG. 10. however, when the inner tube 72 is moved longitudinally forwardly in relation to the sheath 74, as indicated by arrow 91 in FIG. 11, the latch balls 78, 79 roll on the cam surface 69 to the larger diameter cam seat 71, thus are moved radially outwardly to protrude radially through the holes 75, 77 into the channel 80, where they engage shoulder 81 to latch the rod 62 in the plug 64.

When the rod 62 is latched or connected in this manner to the plug 64 in the firearm 38, as described above, a lock bar 24 or cable 16 of a lock device 12 can then be placed through the hole 68, as shown in FIG. 7, to prevent inwardly directed longitudinal movement 82 of the rod 62 in relation to the knob 70 and outer tube 74, which prevents the cam recess 76 from aligning longitudinally with the latch balls 78, 79 and thereby prevents the latch balls 78, 79 from moving radially inward, thus out of the annular channel 80. In such locked condition, the rod 62 cannot be detached from the plug 64, thus cannot be removed from the firearm 38.

Because the lock bar 24 closely abuts the knob portion 70, the inner shaft 72 is prevented from sliding in direction 82 relative to the outer tube 74, which, in turn, prevents the latch balls 78, 79 from retracting into the outer tube 74. The inner shaft 72 is also prevented from moving in a direction opposite that indicated by arrow 82 relative to the outer tube 74, because the end 88 of the inner shaft 72 is too wide to fit between the non-protruding portions of the latch balls 78, 79. Because the inner shaft 72 is not meaningfully able to slide within the outer tube 74 when the lock 12 is attached through the hole 68, the entire barrel rod 62 is prevented from sliding along its longitudinal axis, because the latch balls 78, 79 protrude into the channel 80.

When the latch balls 78, 79 are seated in the channel 80, and the locking device 12 is positioned through the hole 68, the push button 66 and the knob portion 70 protrude outside the barrel opening 30, thus, they serve as a quick visual indicator that the installation procedure has been followed and that the firearm 38 is currently unloaded and safe to handle, store, or display. A light tug or pull on the barrel rod 62 away from the firearm 38 to verify that the barrel rod 62 does not come out of the barrel 32 also serves as a tactile indicator that the installation procedure has been followed and that the firearm 38 is currently unloaded and safe to handle, store, or display. In the explanation above, a lock bar 24 of a paddle lock 12 shown in FIG. 1 or any other suitably sized locking device can be inserted through the hole 68 in the FIG. 7 embodiment to lock the firearm without use of the cable 16. For additional security, the barrel rod 62 of FIG. 7 can be locked to the trigger guard 26 using the cable 16 and locking device 12 in the manner shown in FIG. 1 and described above. Locking the barrel rod 62 to the trigger guard 26 in this fashion further prevents the removal of the barrel rod 62 from the barrel 32. Installation of the firing chamber plug 64 physically obstructs the bullet chamber 50 to prevent the loading of live ammunition.

Figure 13:
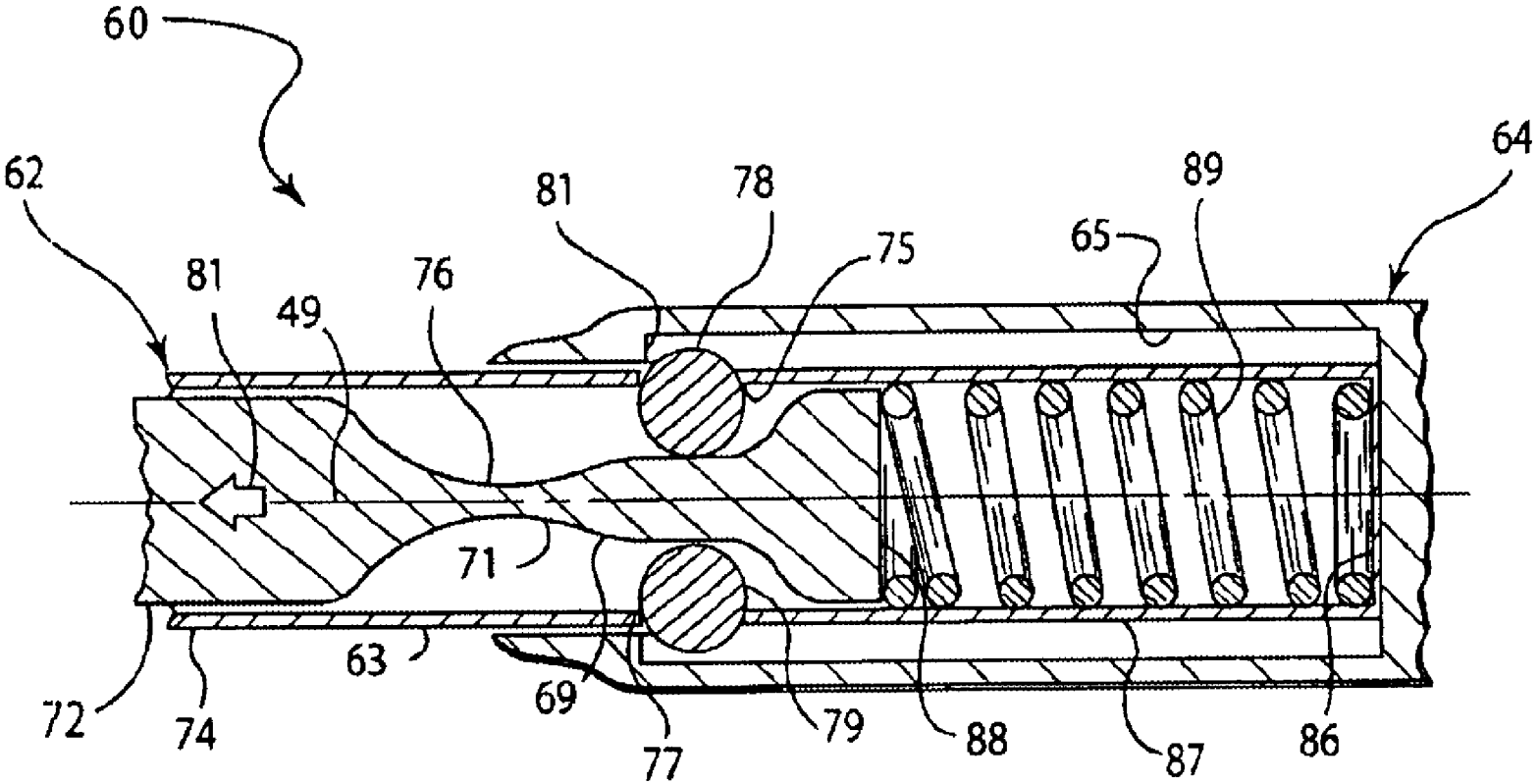
FIG. 13 is an enlarged cross-sectional view similar to FIG. 11, but showing several variations.

Several variations of this latch ball embodiment 60 of the firearm lock of this invention are shown in FIG. 13. In one variation, the bore 65 in the plug 64 and the proximal end portion 87 of the outer tube 74 are lengthened to accommodate a compression spring 89 positioned in the space between the proximal end 88 of the inner shaft 72 and the proximal end cap 86 of the outer tube 74. This spring 89 bears on the proximal end 88 to bias the inner rod 72 in the longitudinal direction of arrow 91 in relation to the outer tube 74. Therefore, when the push button 66 (FIG. 8) is pushed in the direction of arrow 82 in FIG. 8, the inner shaft 72 is pushed against the bias of the spring 89 to collapse the latch balls 78, 79 toward the longitudinal axis 49 for insertion of the rod 62 into the bore 65 of the plug 64. Then, when the pushing force is removed from the push bottom 66 (FIG. 8), the spring bias of compression spring 89 pushes the inner shaft 72 in the direction of arrow 91 to cam the latch balls 78, 79 over cam surface 69 to the seat 71 and, thereby, to set and engage the latch balls 78, 79 with the shoulder 81 in the plug 64.

Another one of the variations shown in FIG. 13 is the larger diameter bore 65 in the plug 64, which eliminates the need for the channel 80 in FIGS. 7–12. A shoulder 81 is still provided to engage the latch balls 78, 79 to prevent withdrawal of the rod 62 from the plug 64.

Figure 14:
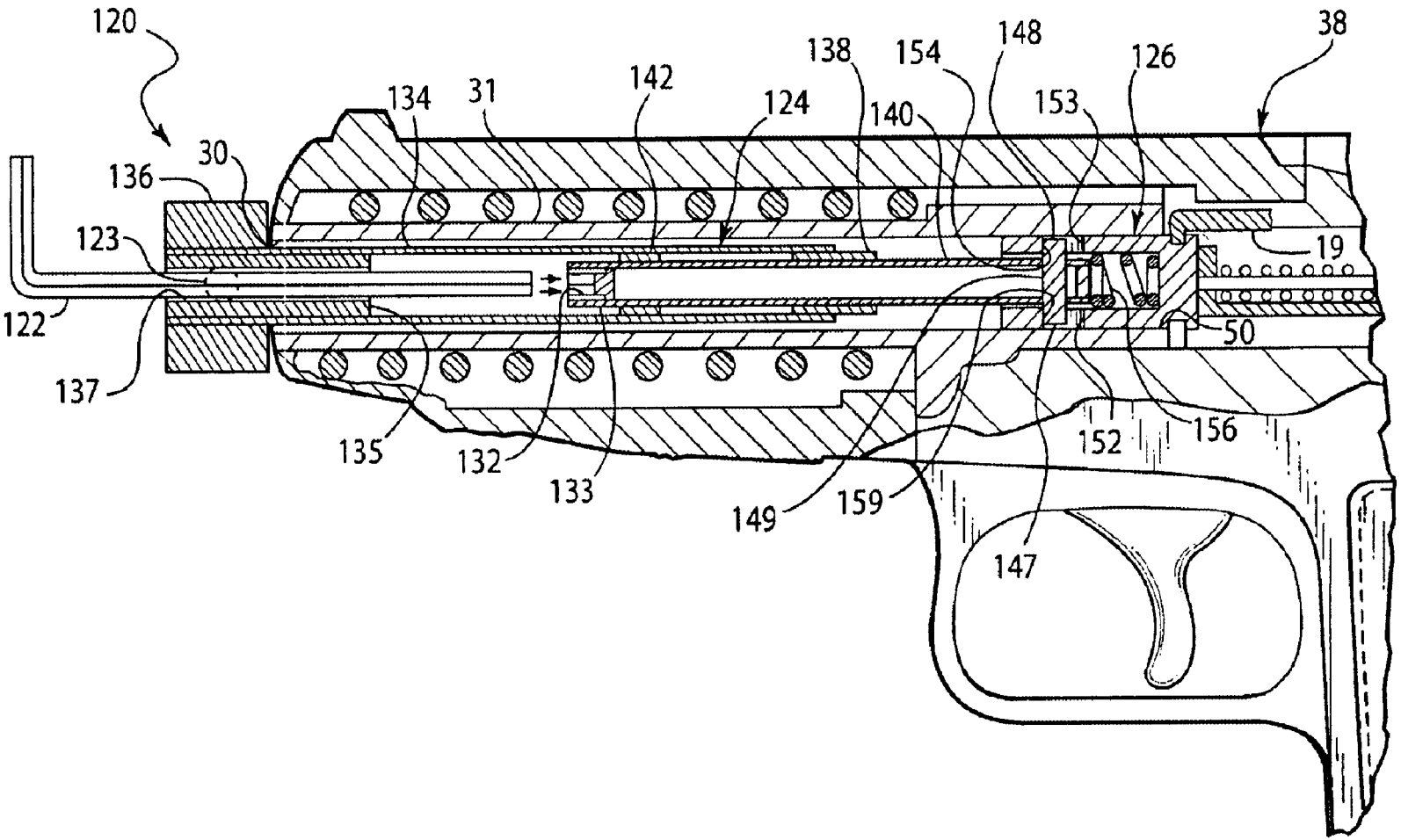
FIG. 14 is a partially cross-sectioned, side elevation view of a firearm equipped with another alternate embodiment of the invention in which longitudinal and transverse slots in the firing chamber plug engage radially extending latch pins on the barrel rod.
Figure 15:
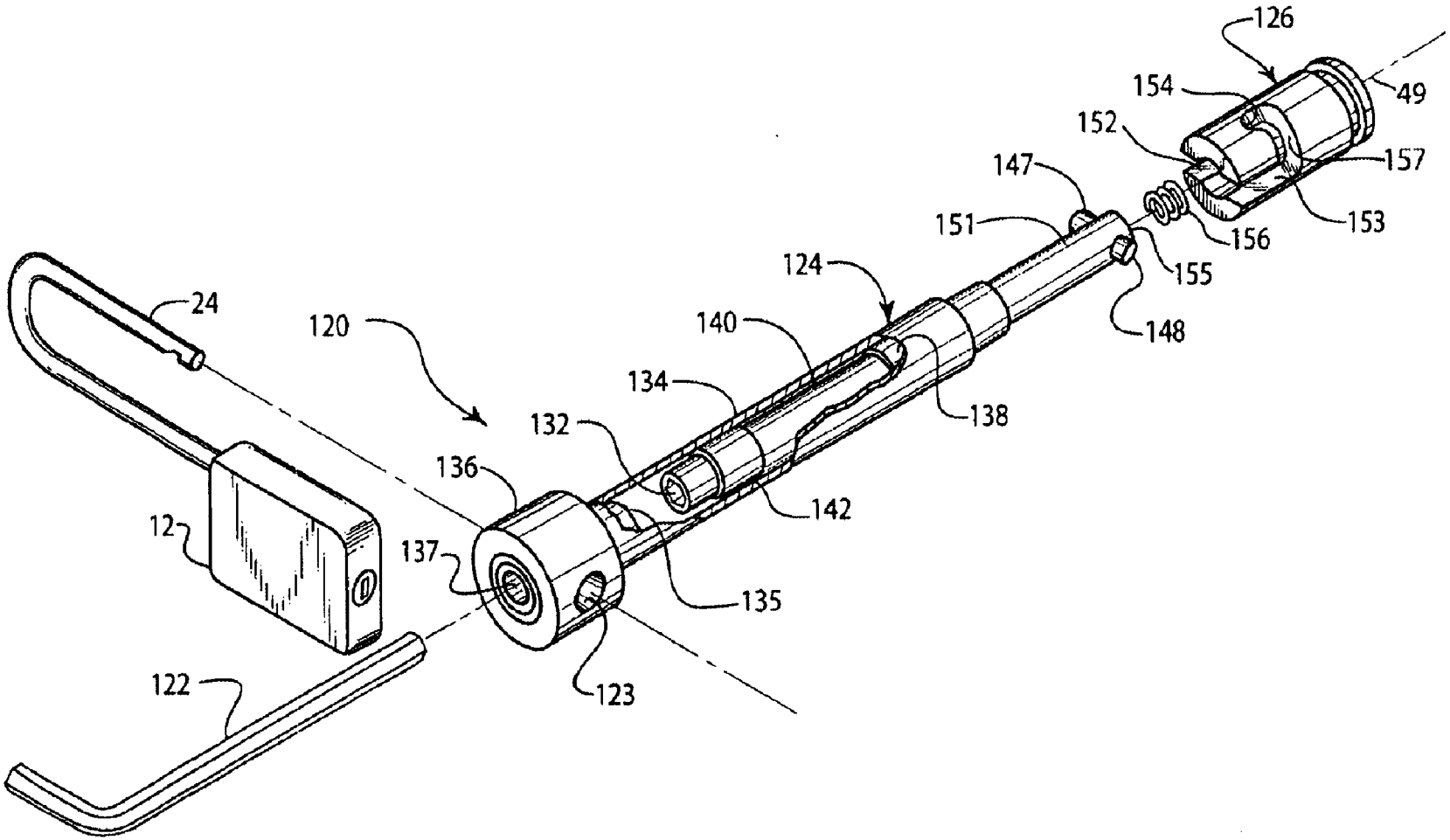
FIG. 15 is an isometric, partially exploded view of the lock apparatus of FIG. 14.

Still another example embodiment 120 of the firearm lock of this invention is shown in FIGS. 14 and 15. This firearm lock embodiment 120 is shown in FIG. 14 installed to lock a firearm 38, and it is shown in FIG. 15 in an isometric, partially exploded, and partially cut away view to better illustrate its component parts. Drawing on the descriptions above of other example embodiments and their attributes in common with this embodiment for locking firearms according to this invention, this firearm lock embodiment 120 also has a firing chamber plug 126 for placement in the firing chamber 50 of the firearm 38 to prevent loading live ammunition rounds into the firing chamber 50. It also has a barrel rod 124 extending through the barrel 31 of the firearm 38 to secure the plug 126 in place. In this firing chamber plug 126, there are two slotted holes 152, 153, which receive and engage opposite ends 147, 148 of a transverse latch pin 149 that protrudes in diametrically opposite directions from the proximal end portion 151 of an inner tube or shaft 140 of the barrel rod 124. A tool 122, such as a hexagonal wrench, (commonly known as an allen wrench), Torx® security wrench, star security wrench, or other shaped wrench, can be inserted through the muzzle 30 of the firearm 38 into engagement with a similarly shaped socket 132 in the distal end portion 133 of the inner tube or shaft 140, where it is used both to push the inner tube 122 longitudinally against the bias of spring 156 into the plug 126 and to twist the inner tube or shaft 140 to engage and disengage the latch protrusions or pins 147, 148 in the plug 126. The tool 122 does not have to be hexagonal, since any configuration that can be used to push and turn the inner tube or shaft 140 will work for this invention.

Still another example embodiment 120 of the firearm lock of this invention is shown in FIGS. 14 and 15. This firearm lock embodiment 120 is shown in FIG. 14 installed to lock a firearm 38, and it is shown in FIG. 15 in an isometric, partially exploded, and partially cut away view to better illustrate its component parts. Drawing on the descriptions above of other example embodiments and their attributes in common with this embodiment for locking firearms according to this invention, this firearm lock embodiment 120 also has a firing chamber plug 126 for placement in the firing chamber 50 of the firing arm 38 to prevent loading live ammunition rounds into the firing chamber 50. It also has a barrel rod 124 extending through the barrel 31 of the firearm 38 to secure the plug 126 in place. In this firing chamber plug 126, there are two slotted holes 152, 153, which receive and engage opposite ends 147, 148 of a transverse latch pin 149 that protrude in diametrically opposite directions from the proximal end portion 151 of an inner tube or shaft 140 of the barrel rod 124. A tool 122, such as a hexagonal wrench, (commonly known as an allen wrench), Torx® security wrench, star security wrench, or other shaped wrench, can be inserted through the muzzle 30 of the firearm 38 into engagement with a similarly shaped socket 132 in the distal end portion 133 of the inner tube or shaft 140, where it is used both to push the inner tube 122 longitudinally against the bias of spring 156 into the plug 126 and to twist the inner tube or shaft 140 to engage and disengage the latch protrusions or pins 147, 148 in the plug 126. The tool 122 does not have to be hexagonal, since any configuration that can be used to push and turn the inner tube or shaft 140 will work for this invention.

The inner tube or shaft 140 slides telescopically within an outer tube 134, and it also rotates freely in relation to the outer tube 134. Therefore, while the outer tube 134 supports the inner tube or shaft 140, it cannot be used either to push the inner tube or shaft 140 longitudinally into the plug 126 against the spring bias of spring 156 or to turn the protrusions 147, 148 into or out of engagement with the plug 126. The slot 153 in the plug extends longitudinally and then transversely at 157 in relation to the longitudinal axis 49. A seating notch 154 then extends longitudinally in the opposite direction to form a secure seat position in the plug 126 for the protrusion 148. The protrusion 148, when seated in notch 154, cannot be disengaged without moving it both longitudinally rearward to the transverse portion 157 and then rotated to the longitudinal slot 153. While not visible entirely in FIG. 15, the slot 152 has a similar shape on the diametrically opposite side of the plug 126 to end at a notch 159, which is visible in FIG. 14. Therefore, the tool 122 is required to disengage the pins 147, 148 on inner tube or shaft 140 from the slot seats 154, 159 in the plug 126.

As best seen in FIG. 14, the inner tube or shaft 140 is preferably not long enough to protrude from the muzzle 30, when the protrusions 147, 148 are engaged with the plug 126, so that it cannot be manipulated from outside the barrel 131 to disengage it from the plug 126. Also, the outer tube 134 and its component parts are preferably sized such that the knob 136 at its distal end abuts the muzzle 30 before any of its components, such as its tool support sleeve 135 or limit stop guide 138, can move far enough longitudinally rearwardly to abut any component or part of the inner tube or shaft 140. Therefore, the outer tube 134 cannot even be manipulated to push the inner tube or shaft 140 longitudinally rearwardly into the plug 126, let alone to rotate it to engage or disengage the pins 147, 148 in the seats 154, 159. Further, it is preferred that the outer tube 134 be made of case hardened steel or other hard material that is resistant to cutting with a hacksaw or other household tool.

A ring guide 142 affixed immovably to the peripheral surface of the inner tube or shaft 140 and a ring sleeve 138 affixed immovably to the inside surface of the outer tube 134 maintain a telescopically slideable, concentric alignment between the inner tube or shaft 140 and the outer tube 134. They are also spaced longitudinally far enough apart from each other to allow some adjustment in overall longitudinal length of the barrel rod 124 to accommodate different barrel lengths of different firearms. However, with enough longitudinal sliding movement of the outer tube 134 the guide ring 142 and ring sleeve 138 will eventually abut each other and provide a limit stop against excessive longitudinal movement and, thereby, to prevent the outer tube 134 from being separated and removed from the inner tube or shaft 140.

While removal of the tool 122 from the firearm lock 120 will provide a certain degree of security, a transverse hole 123 through the knob 136 can be provided to accommodate a lock bar 24 of a paddle lock 12, or a cable (not shown in FIGS. 14 and 15), or other locking device. Essentially, a lock bar 24, cable, or other device extending transversely through the hole 123 in knob 136 will occlude the longitudinal guide hole 137 in tool guide 135 to prevent insertion of either tool 122 or a substitute tool into the barrel rod 124.

Again, as in other embodiments of the invention described above, the firing chamber plug 126 of this firearm lock embodiment 120 prevents loading of live ammunition in the firing chamber 50. Also, the barrel rod 120 not only secures the plug 126 in the firing chamber 50, but its protrusion from the muzzle 30 provides both a visual and tactile indication that the firearm lock 120 is properly installed. Specifically, when the protrusions or pins 147, 148 on the inner tube or shaft 140 are properly engaged in the plug 126, the knob 136 can only be pulled longitudinally away from the muzzle 30 until the ring sleeve 138 on the outer tube 134 abuts the guide sleeve 142 on the inner tube or shaft 140. Therefore, if a person can only pull the knob 136 a finite distance away from the muzzle 30 and then further longitudinal movement of the knob 136 in that direction is not possible, the indication is that the plug 126 is properly and securely in place in the firing chamber 50.

Figure 16:
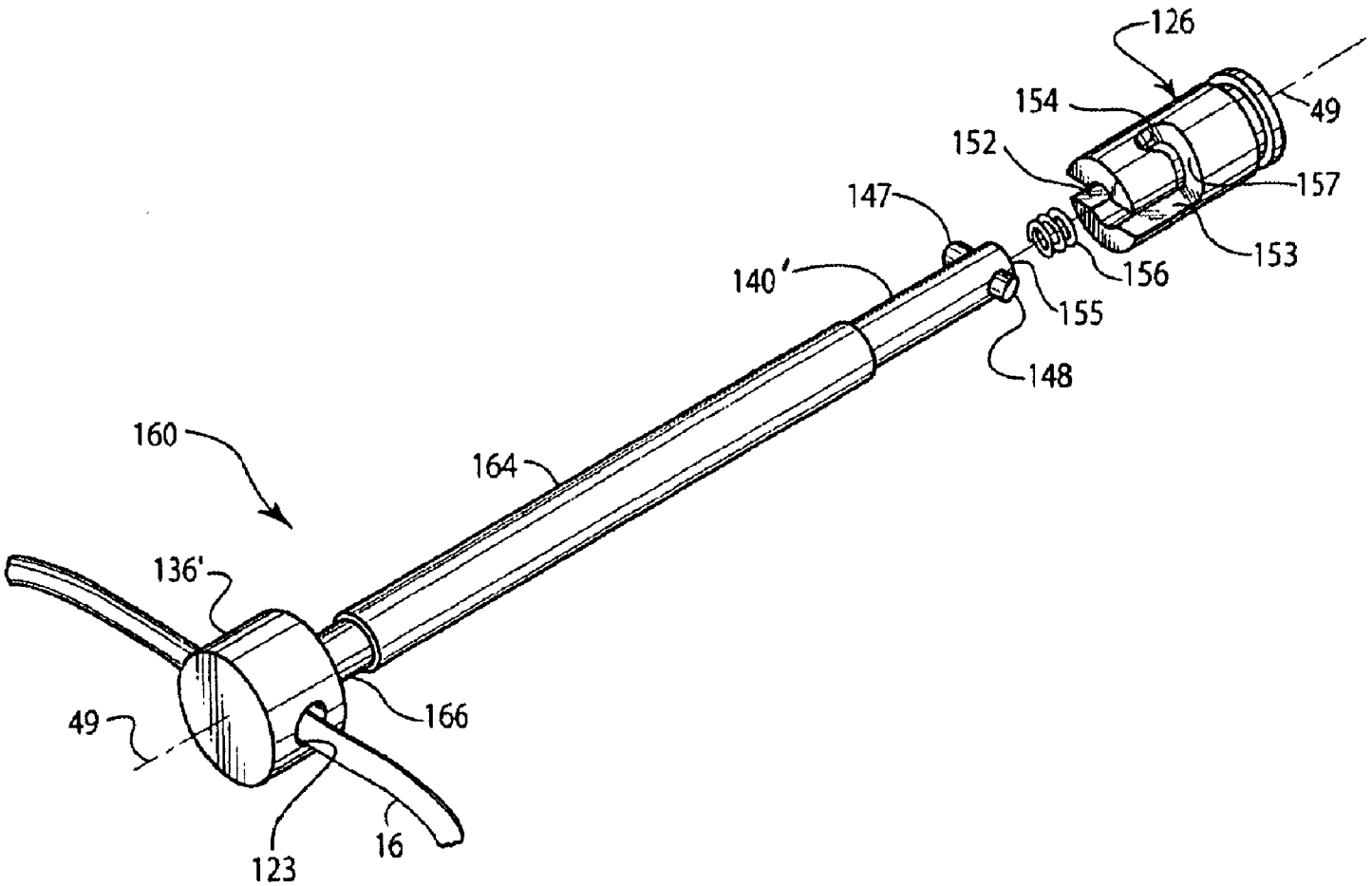
FIG. 16 is an isometric view of a simpler variation of the apparatus in FIG. 15.

A simpler, but less secure, variation 160 of the firearm lock 120 of FIGS. 14 and 15 is shown in FIG. 16. Essentially, the tube or shaft 140' is long enough to extend through the barrel 131 (FIG. 14) of the firearm 38, so that it can be manipulated to engage and disengage the transverse pin protrusions 147, 148 with the plug 126 by pushing and turning the tube or shaft 140' as described above. Since the tube or shaft 140' is accessible outside the barrel 131 of the firearm 38, the tool 122 and outer tube 134 of the FIGS. 14 and 15 embodiment 120 is unnecessary. However, an optional knob 136' can be provided at the distal end 166 of the elongated tube or shaft 140' to facilitate the engagement and disengagement manipulation. A plastic or other soft covering or coating material 164 can be provided around the periphery of the tube or shaft 140' to inhibit scratching the interior surface of the firearm barrel 131, if desired.

A cable 16 can be extended through the hole 123 in the knob 136' and locked to the trigger guard in a manner similar to that shown in FIG. 1, if desired. However, since only a 90° turn of the tube or shaft 140' is required to disengage it from the plug 126, the cable 16 would have to be fastened quite tightly to the trigger guard to prevent such disengagement. Even if the cable 16 is not so tight as to prevent a 90° turn and disengagement of the tube or shaft 140' from the plug 126, though, it can still prevent removal of the tube or shaft 140' from the firearm barrel. Therefore, this condition still provides measure of security and visual indication of locked firearm, even though it might not prevent removal of the plug 126 from the firing chamber. Also, there are lock devices (not shown), such as those used on trailer hitch pins, that can be positioned over and around the periphery of the knob 136' and, when locked in that position, can be rotated freely around the knob 136', but cannot be removed axially from it.

Many other alternate embodiments of the barrel rod, firing chamber plug, cable, and lock can also be used to achieve the objects in accordance with this invention consistent with the spirit and purpose of the invention.

The foregoing description is considered as illustrative of the principles of the invention. Furthermore, since numerous modifications and changes will readily occur to those skilled in the art, it is not desired to limit the invention to the exact construction and process shown and described above. Accordingly, resort may be made to all suitable modifications and equivalents that fall within the scope of the invention. The words "comprise," "comprises," "comprising," "include," "including," and "includes" when used in this specification are intended to specify the presence of stated features, integers, components, or steps, but they do not preclude the presence or addition of one or more other features, integers, components, steps, or groups thereof.

The embodiments of the invention in which an exclusive property or privilege is claimed are defined as follows:

1. A system for locking a firearm, the system comprising:

a barrel rod comprising a pair of pins configured to protrude outward from a longitudinal axis of the barrel rod, wherein the barrel rod is rigid and is longer than a barrel of the firearm and is of sufficient length to protrude from the barrel of the firearm; and a firing chamber plug sized to fit within a firing chamber of the firearm and configured to removably engage the pair of pins of the barrel rod, wherein the firing chamber plug comprises:

a hole for receiving an end of the barrel rod;

a spring compressed by the end of the barrel rod;

a first pair of grooves for receiving the pair of pins and for guiding the pair of pins longitudinally along the firing chamber plug;

a second pair of grooves connected transversely to the first pair of grooves for guiding the pair of pins transversely as the barrel rod turns; and a third pair of grooves connected to the second pair of grooves for seating the pair of pins after the spring pushes the pair of pins into the third pair of grooves, wherein the third pair of grooves is configured to prevent the barrel rod from turning.

2. The system of claim 1 wherein the barrel rod comprises a knurled knob to facilitate pushing and turning of the barrel rod with fingers.

3. A system for locking a firearm, the system comprising:

a barrel rod comprising a pair of pins configured to protrude outward from a longitudinal axis of the barrel rod, wherein the barrel rod is rigid and is longer than a barrel of the firearm and is of sufficient length to protrude from the barrel of the firearm;

a firing chamber plug sized to fit within a firing chamber of the firearm and configured to removably engage the pair of pins of the barrel rod; and wherein the barrel rod also comprises: (i) an inner shaft shorter in length than the barrel, the pair of pins protruding from the inner shaft; and (ii) an outer tube comprising a first hole, the outer tube being configured to fit over the inner shaft and to slide and turn freely over the inner shaft such that turning or depressing the outer tube neither turns nor depresses the inner shaft, the outer tube protrudes from the barrel and permits access to the inner shaft through the first hole such that the barrel rod can be disengaged from the firing chamber plug only by accessing the inner shaft through the first hole with a tool.

4. The system of claim 3 wherein the tool is a hexagonal wrench.

5. Firearm lock apparatus, comprising:

a barrel rod comprising a proximal end, a distal end, and at least one pin adjacent the proximal end protruding radially outward in relation to a longitudinal axis of the barrel rod, wherein the barrel rod is small enough in diameter to extend through the barrel to a firing chamber of the firearm; and a firing chamber plug sized to fit within the firing chamber of the firearm, said firing chamber plug comprising: (i) a hole for receiving the proximal end of the barrel rod; (ii) a first groove for receiving the pin and for guiding the pin longitudinally along the firing chamber plug as the proximal end of the barrel rod slides into the hole in the firing chamber plug; (iii) a second groove connected transversely to the first groove for guiding the pin transversely as the barrel rod turns in the firing chamber plug; and (iv) a third groove connected to and protruding longitudinally from the second groove for seating the pin in a manner that prevents the barrel rod from turning whenever the pin is seated in said third groove.

6. The firearm lock apparatus of claim 5, including a spring positioned in a manner that provides a spring bias between the barrel rod and the firing chamber plug that requires the spring to be compressed in order for the end of the barrel rod to be inserted far enough into the hole in the firing chamber plug for the pin to be seated in the third groove and that requires the spring to be compressed in order for the pins to be unseated from the third groove.

7. The firearm lock apparatus of claim 6, wherein the spring is a coiled compression spring positioned in the hole in the firing chamber plug.

8. Firearm lock apparatus for locking a firearm that has a barrel extending in a distal direction from a firing chamber, comprising:

a firing chamber plug that is sized and shaped to fit in the firing chamber of the firearm in a manner that prevents the firing chamber plug from being moveable from the firing chamber into the barrel of the firearm, said firing chamber plug having an attachment structure that releasably engages a mating attachment structure on a proximal end of an inner shaft of a barrel rod in a manner that prohibit separation of the barrel rod from the firing chamber plug without first turning the inner shaft in relation to the firing chamber plug, said inner shaft of the barrel rod also having a tool engagement structure at its distal end for mating engagement with a tool that, when engaged with the tool engagement structure, can be used to turn the inner shaft of the barrel rod in relation to the firing chamber plug; and said barrel rod also having an outer tube positioned over and extending longitudinally beyond the distal end of the inner shaft in a manner that allows free rotation of the outer tube in relation to the inner shaft, but wherein said outer tube is blocked against separation from the inner shaft so that the outer tube cannot be used to turn the inner shaft in relation to the firing chamber plug and cannot be separated from the inner shaft; said outer tube being long enough to extend out of the barrel of the firearm from a location inside the barrel when the inner shaft is attached to the firing chamber plug by the attachment structures on the firing chamber plug and the inner shaft so that the inner shaft, when detached from the firing chamber plug, can be removed from the barrel of the outer tube; and said outer tube having a hole in its distal end to accommodate insertion of the tool longitudinally through the outer tube to the tool engagement structure at the distal end of the inner shaft.

9. The firearm lock apparatus of claim 8, wherein the mating attachment structures on the inner shaft and the firing chamber plug are configured to require both longitudinal and rotational movement of the inner shaft in relation to the firing chamber plug to detach the inner shaft from the firing chamber plug, and wherein the outer tube is also slideable longitudinally in a telescopic manner in relation to the inner shaft so that the outer tube also cannot be used to impart longitudinal movement to the inner shaft in relation to the firing chamber plug.

10. The firearm lock apparatus of claim 9, an enlargement on the outer tube in a location that is outside the barrel of the firearm when the inner shaft is attached to the firing chamber plug in the firing chamber of the firearm, said enlargement being larger in diameter than the barrel to thereby function as a limit stop against the barrel to limit longitudinal movement of the outer tube toward the proximal end of the inner shaft.

11. The firearm lock apparatus of claim 10, including a transverse hole through the outer tube adjacent the distal end of the outer tube, and a lock device that is extendable through the hole to block extension of the tool through the outer tube to the inner shaft.

12. Firearm locking apparatus, comprising:

firing chamber plug means for placement in a firing chamber of the firearm to prevent a live ammunition cartridge from being placed in the firing chamber;

a shaft sized for being positioned in a barrel of the firearm and extending to the firing chamber plug means, said shaft being attachable to the firing chamber plug means to prevent removal of the firing chamber plug means from the firing chamber;

attachment means for attaching the shaft to the firing chamber plug means in a manner that requires both longitudinal and rotational movement of the shaft in relation to the firing chamber plug means to detach the shaft from the firing chamber plug means in order to remove the firing chamber plug means from the firing chamber;

tool engagement means at a distal end of the shaft for receiving a tool that can impart both longitudinal and rotational motion to the shaft for detaching the shaft from the firing chamber plug means; and means for inserting the shaft into and removing the shaft from the barrel and for covering the shaft so that the shaft and the tool engagement means are accessible only by the tool when the shaft is attached to the firing chamber plug means.

13. The firearm locking apparatus of claim 12, wherein said means for asserting the shaft into and removing the shaft from the barrel and for covering the shaft includes an outer tube positioned telescopically over the shaft, means for connecting the outer tube to the shaft in a manner that allows the outer tube to rotate freely in relation to the shaft and to move longitudinally in relation to the shaft so that the outer tube cannot impart the longitudinal and rotational motion to the shaft needed to detach the shaft from the firing chamber plug means, but wherein such longitudinal movement is limited so that the outer tube cannot separate from the shaft as the outer tube is pulled out of the barrel, said tool engagement means being reachable by the tool through a hole at a distal end of the outer tube.

14. The firearm locking apparatus of claim 13, including means for preventing longitudinal movement of the outer tube toward the firing chamber plug far enough either to impart longitudinal movement from the outer tube to the shaft or to expose the tool engagement means outside the outer tube.

15. The firearm locking apparatus of claim 13, including means for removably occluding the hole in the outer tube to prevent insertion of the tool through the outer tube to the tool engagement means.

16. The firearm locking apparatus of claim 12, wherein the attachment means includes a protrusion adjacent the proximal end of the shaft extending radially outward in relation to a longitudinal axis of the shaft, and the firing chamber plug means having an axial hole large enough to receive the proximal end of the shaft, a longitudinal slot for receiving and guiding the protrusion as the shaft slides longitudinally into the hole, a transverse slot extending from the longitudinal slot for receiving and guiding the protrusion as the shaft rotates in the hole, and a reverse longitudinal slot for receiving and seating the protrusion upon reverse longitudinal movement of the shaft.

17. The firearm locking apparatus of claim 16, including means for resisting but not prohibiting longitudinal movement of the shaft into the hole in the firing chamber plug means and for thereby also resisting but not prohibiting unseating of the protrusion from the reverse longitudinal slot.

18. The firearm locking apparatus of claim 17, wherein the means for resisting longitudinal movement of the shaft into the hole comprises a coil spring positioned to abut the shaft on one end of the spring and to abut the firing chamber plug means on the opposite end of the spring.

19. The firearm locking apparatus of claim 18, wherein the coil spring is positioned in the hole in the firing chamber plug means.

20. A method of locking and unlocking a firearm, comprising:

positioning a plug in a firing chamber of the firearm;

extending a rod from a barrel of the firearm to the plug;

attaching the rod to the plug in a manner that requires both longitudinal and rotational movement of the rod in relation to the plug for detaching the rod from the plug by extending a tool to engage the shaft through an outer tube that is positioned in a manner that is freely slideable longitudinally and rotationally over the shaft and that extends out of the barrel, and by using the tool through the outer tube to push the shaft toward the plug and to rotate the shaft in relation to the plug to make the attachment, and then removing the tool from the outer tube;

detaching the rod from the plug by inserting the tool through the outer tube to engage the shaft, pushing the shaft with the tool longitudinally toward the plug and rotating the shaft in relation to the plug with the tool;

pulling the shaft out of the barrel with the outer tube; and removing the plug from the firing chamber.

21. The method of claim 20, including making the attachment by using the tool to push the shaft into a hole in the plug against a spring bias to slide a radial protrusion on the shaft into and longitudinally along a longitudinal slot in the plug and to turn the shaft in the plug to slide the protrusion into a transverse slot to a reverse longitudinal slot, and letting the spring bias seat the protrusion in the verse longitudinal slot.

22. The method of claim 21, including detaching the shaft from the plug by using the tool to push the shaft against the spring bias to unseat the protrusion from the reverse longitudinal slot and to turn the shaft to move the protrusion along the transverse slot to the longitudinal slot, and letting the spring bias push the shaft out of the hole in the plug.

23. The method of claim 20, including blocking access of the tool to the shaft by placing an obstruction through a transverse hole in the outer tube.

* * * * *